US006484650B1

(12) United States Patent
Stomski

(10) Patent No.: US 6,484,650 B1
(45) Date of Patent: Nov. 26, 2002

(54) AUTOMATED SECURITY CHAMBERS FOR QUEUES

(76) Inventor: Gerald D. Stomski, 54 Washington Rd., Woodbury, CT (US) 06798

( * ) Notice: Subject to any disclaimer, the term of this patent is extended or adjusted under 35 U.S.C. 154(b) by 0 days.

(21) Appl. No.: 09/683,272

(22) Filed: Dec. 6, 2001

(51) Int. Cl.[7] ..... E05G 5/00
(52) U.S. Cl. ..... 109/6; 109/7; 109/68
(58) Field of Search ..... 109/15, 2, 3, 6–11, 109/21, 67, 68

(56) References Cited

U.S. PATENT DOCUMENTS

| | | | | | |
|---|---|---|---|---|---|
| 1,008,125 | A | | 11/1911 | Eichelkraut | 109/4 |
| 3,564,132 | A | * | 2/1971 | Baker | 109/6 X |
| 3,669,038 | A | * | 6/1972 | Watson | 109/12 |
| 3,675,599 | A | * | 7/1972 | Shively | 109/11 |
| 3,965,827 | A | | 6/1976 | Reeves | 109/3 |
| 4,137,567 | A | | 1/1979 | Grube | 364/567 |
| 4,308,803 | A | * | 1/1982 | Pretini | 109/21 X |
| 4,380,201 | A | * | 4/1983 | Dion | 109/5 X |
| 4,481,887 | A | * | 11/1984 | Urbano | 109/6 X |
| 4,586,441 | A | | 5/1986 | Zekich | 109/8 |
| 4,656,954 | A | * | 4/1987 | Tonali | 109/6 |
| 4,741,275 | A | * | 5/1988 | Lewiner et al. | 109/7 |
| 4,773,338 | A | | 9/1988 | Hastings | 109/2 |
| 4,947,765 | A | * | 8/1990 | Biedess | 109/6 |
| 5,195,448 | A | * | 3/1993 | Sims | 109/6 |
| 5,311,166 | A | * | 5/1994 | Frye | 109/6 X |
| 5,400,722 | A | * | 3/1995 | Moses et al. | 109/7 X |
| 5,542,211 | A | * | 8/1996 | Colombo | 109/8 X |
| 5,692,446 | A | * | 12/1997 | Becker et al. | 109/3 |
| 5,694,867 | A | * | 12/1997 | Diaz-Lopez | 109/6 |
| 5,769,011 | A | * | 6/1998 | Daniel | 109/7 |
| 5,992,094 | A | * | 11/1999 | Diaz | 49/31 |
| 6,308,644 | B1 | * | 10/2001 | Diaz | 109/6 |

* cited by examiner

*Primary Examiner*—Suzanne Dino Barrett
(74) *Attorney, Agent, or Firm*—William C. Crutcher

(57) ABSTRACT

A security system having a series of adjacent bullet-proof transparent chambers for successive passage of persons in a queue. A door interlock system controls passage of individuals along with intermittent movement of a conveyor for inspecting hand-carried articles. The system includes manual and automatic controls for detaining a suspected individual and unlocking doors to allow release of other individuals in the chambers. A matrix of such chambers is shown, which handles security check-in for several queues of airline passengers.

19 Claims, 5 Drawing Sheets

AUTOMATED SECURITY CHAMBERS FOR QUEUES

BACKGROUND OF INVENTION

This invention relates generally to security systems for protecting members of the public during processing of a queue of successively arriving persons entering or doing business in a secure area, such as a bank or a secured area for departing airline passengers. More particularly, the invention relates to a system for screening or monitoring persons in a queue and isolating and temporarily confining any specific person, who might be transporting weapons or materials deemed to be a threat to others in the secure area.

There are many situations when a person, who is possibly carrying a weapon or harmful substance, must be checked for the presence of these items before being allowed to proceed to a secure area, or to do business where money or other valuable objects are exchanged. There is a long history of protective devices intended to shield bank tellers from an individual who might be carrying a weapon. Devices suggested in the early prior art include U.S. Pat. No. 1,008,125 issued Nov. 7, 1911 to Eichelkraut. That patent describes a security chamber for regulating and controlling the access of persons to cashier's windows in banks, post offices, theaters and the like, having an interlocking arrangement between the door and the cash window, whereby the window can only be opened when the door is closed and whereby the door can only be opened when the window is closed. This concept has been expanded in patents such as U.S. Pat. No. 4,773,338 issued to Hastings on Sep. 28, 1988, wherein a group of cylindrical modules of transparent bullet-proof glass or plastic are positioned in front of respective bank tellers. The Hastings patent provides for the teller to override the individual's control over the doors to the modules, so as to temporarily confine the occupant until the police arrive. While this system is adequate to confine a single person once the person has exposed a weapon or made a threat while inside a module, it does nothing to detect the weapon or harmful substance in advance of entering the module and consequently exposes the surrounding personnel to injury.

U.S. Pat. No. 3,965,827 issued Jun. 29, 1976 to Reeves takes a more direct approach by dropping a bullet-proof transparent cage over a criminal who is unfortunate enough to be standing beneath the cage.

A more sophisticated arrangement for detecting weapons, including x-raying hand luggage and interrogating a person seeking passage from a non-secure area to a secure area is disclosed in U.S. Pat. No. 4,586,441 issued May 6, 1986 to Zekich. This system employs a first partitioned revolving door leading to a detection chamber, from which the person departs via a second partitioned revolving door. A search room adjoins the detection chamber and is equipped with door interlocks preventing escape of an individual in the search room. Zekich proposes a number of high security sensors and identification detection devices such as a metal detector, air sampling, excess weight detection, hand geometry reading and so forth. A bullet-proof wall protects the interrogation personnel, but there is no means to protect other people in the queue being screened.

Recently, heightened security measures are being applied at airports to closely monitor departing airline passengers. Traditionally, unorganized queues of passengers place their hand luggage upon conveyor belts passing through an x-ray machine, and then walk through metal detection gates to retrieve their hand luggage.

Randomly, the passengers are checked with metal detection wands and hand luggage is inspected. These measures have proved to be inadequate. U.S. Pat. No. 4,137,567 issued Jan. 30, 1979 to Grube discloses a system for passengers to accompany both their hand luggage and checked luggage, including weighing the passenger both at the security check point and at the boarding gate. However, presence of a dangerous substance or weapon found at either location poses danger to surrounding passengers and security personnel.

Accordingly, one object of the present invention is to process a queue from a non-secure area to a secure area, while checking the persons in the queue and protecting surrounding personnel.

Another object of the invention is to provide a secure transit of passengers to an aircraft while detecting weapons or harmful substances carried by passengers.

Still another object of the invention is to provide secure processing of multiple queues and temporarily confining a person in a queue found to possess threatening objects.

SUMMARY OF INVENTION

Briefly stated, the invention is practiced by providing a security system for monitoring and protecting personnel in an area including at least one queue of successively arriving individuals, comprising a plurality of at least three contiguous chambers, including an entry chamber, an exit chamber and at least one intermediate chamber, said chambers each having bullet-proof transparent walls and bullet-proof doors, said doors including an entry door to the entry chamber, an exit door from the exit chamber, a common door between each intermediate chamber and said contiguous chamber, said doors having remotely controlled locks, means for monitoring a selected individual in a selected chamber, and an automated door interlock system arranged and adapted to remotely unlock selected locks to pass individuals successively through said chambers, and to lock selected locks to detain selected individuals during monitoring.

BRIEF DESCRIPTION OF DRAWINGS

The invention will be better understood by reference to the following description, taken in connection with the accompanying drawings, in which.

DETAILED DESCRIPTION

Figure 1:
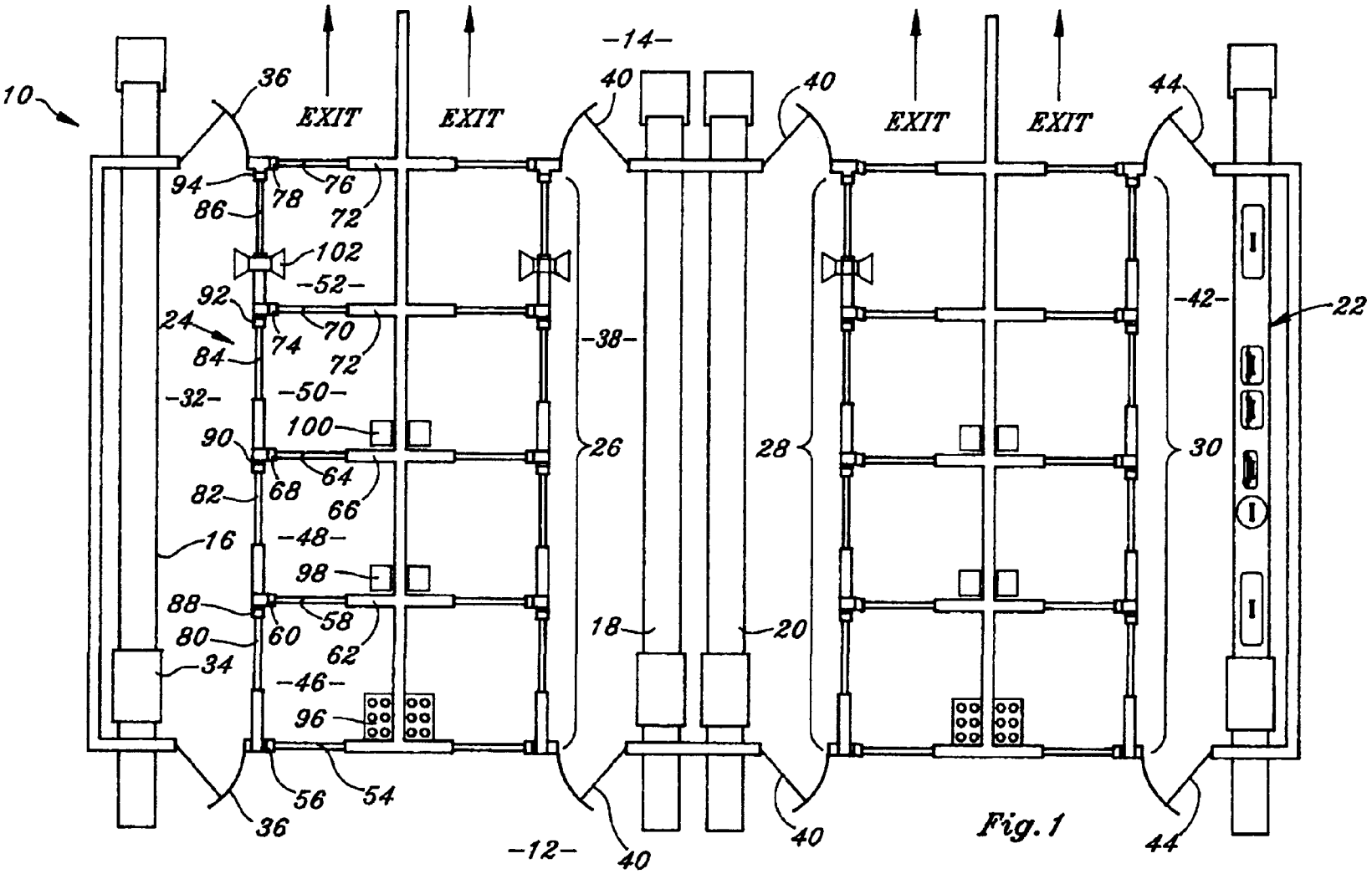
FIG. 1 is a schematic plan view of an aircraft security check point for multiple queues of passengers.
Figure 2:
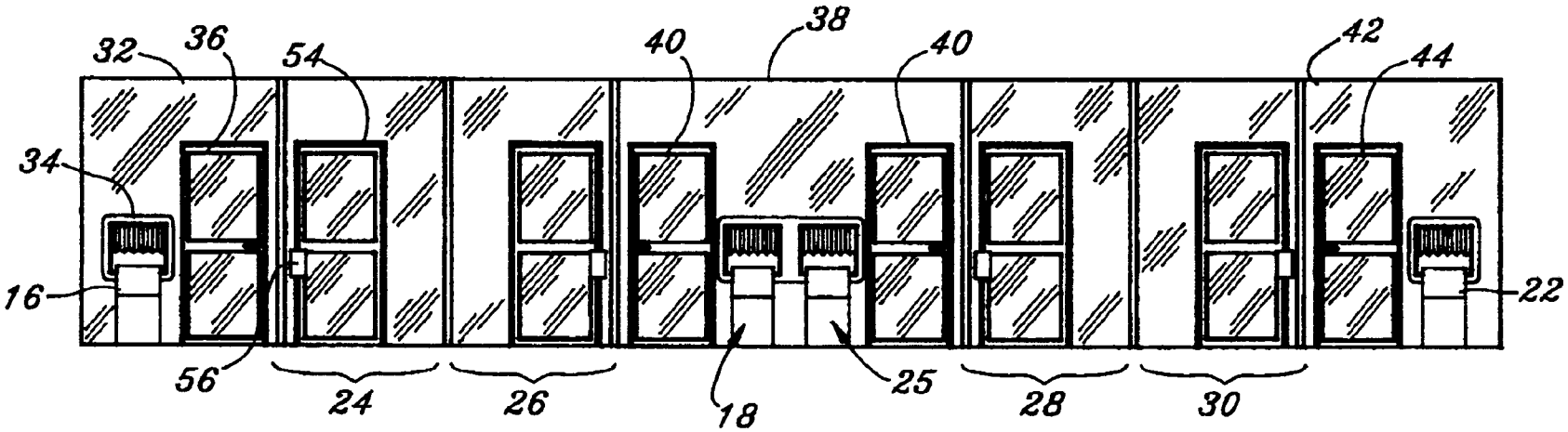
FIG. 2 is a front elevation view of the security check point of FIG. 1.

Referring now to FIGS. 1 and 2 of the drawings, a security system shown generally as 10 is disposed as a check point between a non-secure area 12 where passengers and their accompanying parties may intermingle in an airport, and a secure area 74 reserved only for monitored passengers and flight personnel. The check point 10 comprises a matrix of security chambers and hand luggage conveyor chambers.

The hand luggage conveyors are shown generally at 16, 78, 20 and 22. Conveyor 76 is disposed alongside a line of security chambers 24. Similarly, conveyor 78 is disposed along an identical line 26 of identical security chambers. Similarly, conveyor 20 is disposed alongside a line 28 of security chambers and conveyor 22 alongside a line 30 of security chambers.

Each of the strings of security chambers 24, 26, 28 and 30 are identical and a detailed description will follow of only one line of security chambers after first describing the general layout. A conveyor and surveillance room 32 containing the conveyor 16 with x-ray surveillance equipment 34 is manned by security personnel and entered from doors 36. Similarly, a room 38 houses conveyors 18, 20, along with associated security personnel, entered by doors 40. A room 42 entered from doors 44 houses conveyor 22.

Since each of the line of successive security chambers 24, 26, 28 and 30 are identical, only the line of security chambers 24 with its associated conveyor 16 will be described in detail. It is understood that this description also applies to line of security chambers 26 associated with conveyor 78, line of security chambers 28 associated with conveyor 20 and line of security chambers 30 associated with conveyor 22.

The line of security chambers 24 comprises an entry chamber 46, a first intermediate chamber 48, a second intermediate chamber 50, and an exit chamber 52. Additional intermediate chambers may be interposed between entry chamber 46 and exit chamber 52, or there may be only one intermediate chamber, depending upon the degree of security required, and the number and type of security threats monitored. All of the security chambers 46–52 have bullet-proof walls and doors and are constructed partially or wholly out of transparent material as much as possible so that the occupants can be observed. The use of transparent material not only permits observation of possible criminal activities, but prevents undue anxiety of individuals in the security chambers. Suitable material may consist of bullet-proof glass or transparent bullet-proof plastics combined with bullet-proof framework members, and a roof with suitable ventilation system (not shown).

Access to entry chamber 46 is gained by a sliding door 54 with a remotely controlled locking device 56. Passage from entry chamber 46 to the first intermediate chamber 48 is through a sliding door 58 with a remotely controlled lock 60. Chambers 46 and 48 share a common wall 62. Similarly, passage from chamber 48 to chamber 50 is through a sliding door 64 in a common wall 66 with a remotely controlled lock 68. Passage from intermediate chamber 50 to exit chamber 52 is through a sliding door 70 in a common wall 72 with remotely controlled lock 74, and exit from chamber 52 is through a sliding door 76 with remotely controlled lock 78.

In order for security personnel in conveyor and surveillance room 32 to enter, interrogate and/or remove personnel from any of the security chambers, outer access doors 80, 82, 84, 86 are provided. Doors 80, 82, 84, 86 respectively have locks 88, 90, 92, 94. Locks 88–94 can only be operated from room 32.

As will be explained, a door interlock control allows passage of successive passengers from one chamber to the next. Conveyor 16, rather than running continuously as it does in present airport security systems, operates intermittently. The conveyor is automatically started when the queue advances persons from one chamber to the next and then is automatically stopped until another advance takes place. In this way, an individual always has its hand-carried articles in view and can also answer questions and view the operation in the event that these are inspected by security personnel in room 32.

The type of security checks and identification requirement in each of the security chambers will vary with the type of secure area and the degree of security required. The following description of devices in chambers 46–52 is only exemplary. Further details and suggestions may be found in the prior art, such as in the aforementioned U.S. Pat. Nos. 4,586,441 and 4,773,338, which are incorporated herein by reference. The sensors and identification devices mentioned are commercially available and do not form part of the present invention.

Entry chamber 46 may contain basic identification equipment, such as a keyboard or card reader 96, into which the passenger may enter ticket number or personal identification data to verify its identity, ticket number and destination.

First intermediate chamber 48 contains a first set of sensing equipment exemplified by a sensor 98, such as electromagnetic metal detector. Second intermediate chamber 50 contains other sensing devices, such as the sensor indicated at 100. This may be an air sampling device for detecting explosives, incendiary devices, or other materials in gaseous form. Chamber 50 may therefore be equipped with an atmospheric control system for sealing chamber 50 temporarily from the other security chambers. Such equipment is not shown, being conventional and obtainable from commercial sources.

Chamber 52 may comprise an interrogation chamber having two-way communicating device 102 for answering any questions concerning contents of hand carried articles on the conveyor belt. In addition to the two-way communicating device 102 for private communications with the occupant of exit chamber 52, a general automatic annunciator system (not shown) provides a recorded message announcing unlocking and locking of the automatic doors 54, 58, 64, 70, 76, so that the queue can advance.

Figure 3:
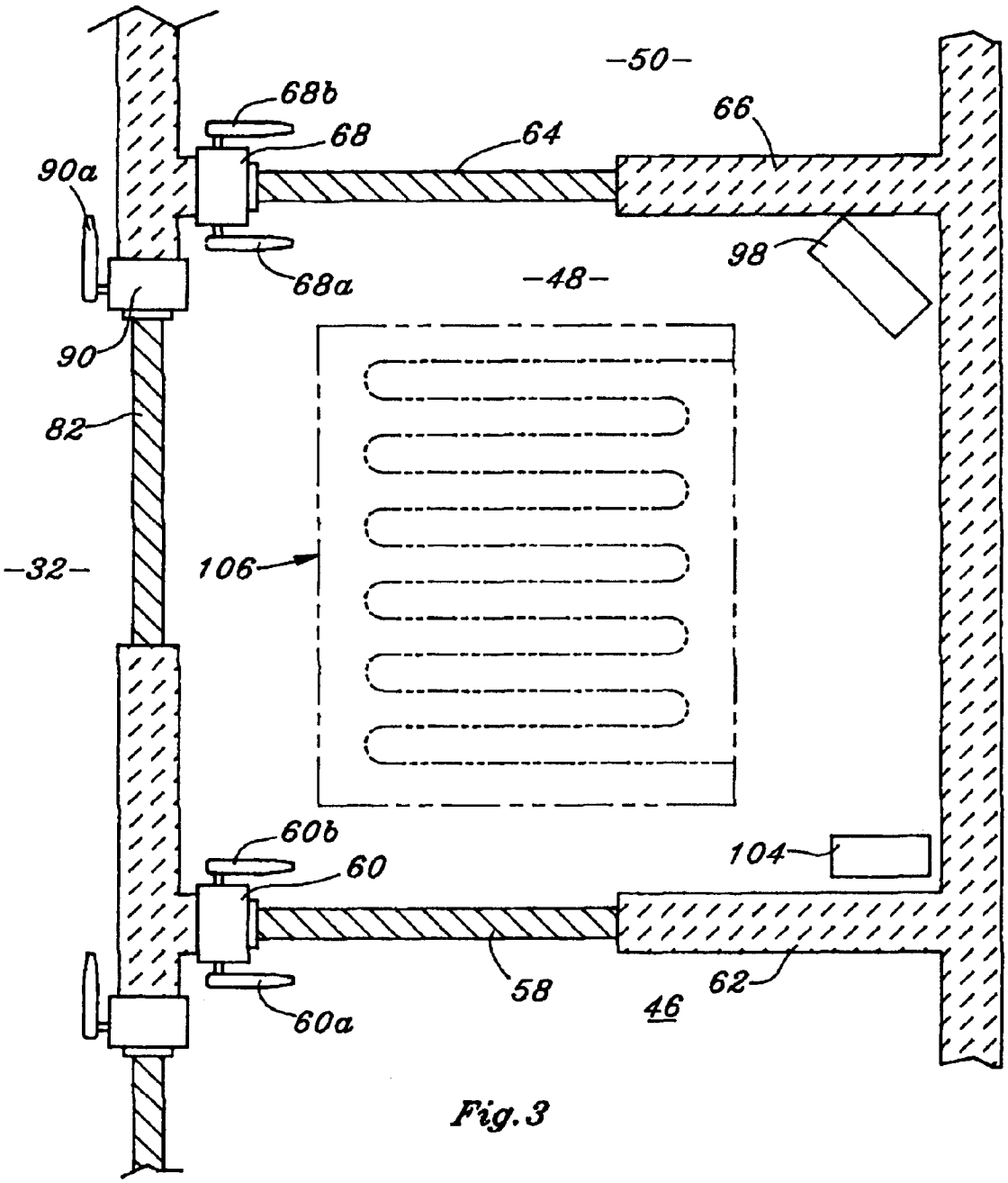
FIG. 3 is an enlarged plan view of one of the security chambers shown in FIG. 1.

Referring now to FIG. 3 of the drawing, details of one intermediate chamber 48 are shown with respect to one form of remotely controlled door lock. As previously described, transparent bullet-proof wall 62 and its sliding door 58 are common to the first intermediate chamber 48 and the contiguous entry chamber 46. Similarly wall 66 with its sliding door 64 are common to intermediate chamber 48 and the contiguous second intermediate chamber 50. Entry to chamber 48 is allowed by remotely controlled lock 60 and exit from chamber 48 is allowed by remotely controlled lock 68. In the arrangement shown in FIG. 3, the locks 60, 68 have handles 60*a*, 60*b*, 68*a*, 68*b* which may be turned when unlocked by the remote control system, so that sliding doors 58, 64 may be manually opened. A suitable sensor to indicate presence of an individual in chamber 48 is provided by an infrared sensor 104, or alternately by a floor pad 106 operating a contact when there is a pre-determined weight placed upon it.

As mentioned previously, security personnel may access chamber 48 from room 32 by operating a handle 90*a* on lock 90 to release sliding door 82. Lock 90 may only be operated from outside the chamber.

Figure 4A:
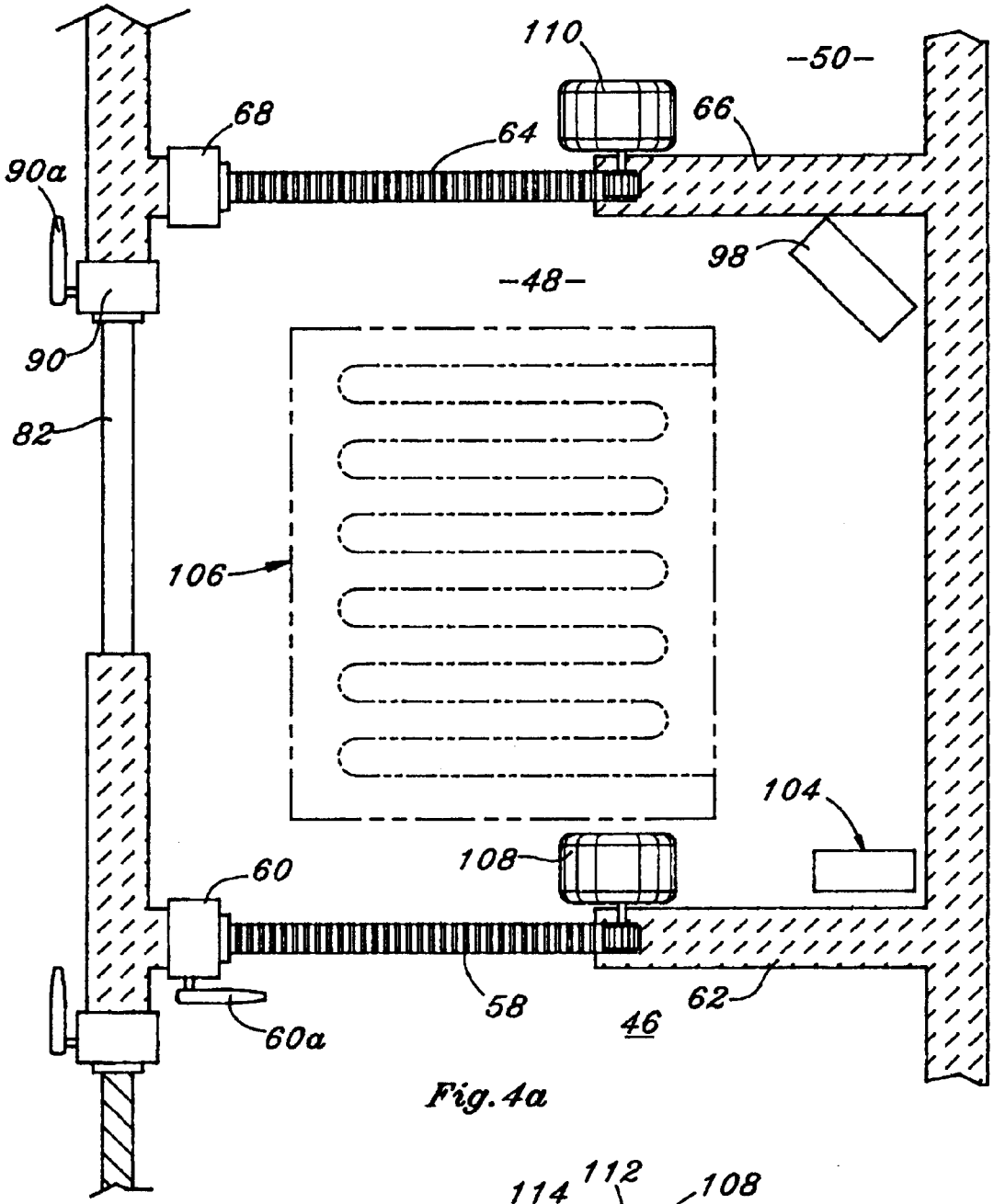
FIG. 4*a* is a similar enlarged plan view of a single security chamber with a different door mechanism.
Figure 4B:
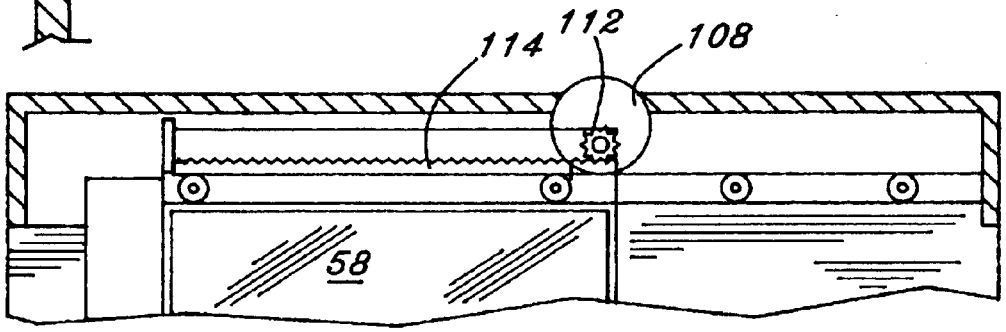
FIG. 4*b* is a front elevation view, partly in cross section of the security chamber of FIG. 4*a*.

An alternate arrangement for security chamber 48 with automatically opening doors is shown in FIGS. 4*a* and 4*b*. Previously described elements have the same reference numbers as mentioned in connection with FIG. 3. Rather than having remotely controlled locks on manually operated doors, the sliding doors 58, 64 are automatically opened when locks 60, 68 are remotely unlocked, and power is supplied to electric motors 108, 110. Through a gear 112 and rack 714, doors 58, 64 are automatically opened to permit transit of the queue from one security chamber to the next, and automatically closed after the queue advances.

Figure 5:
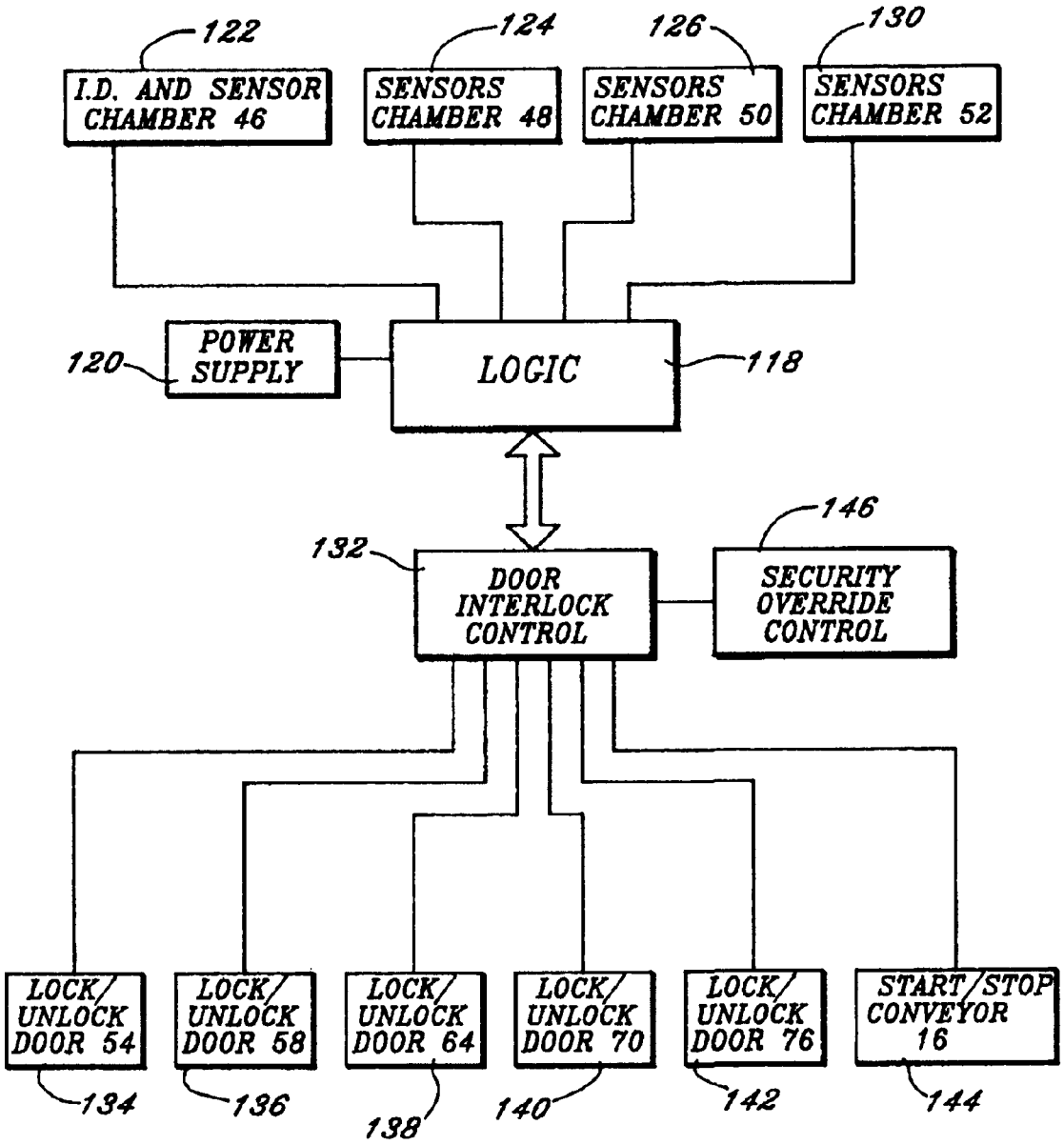
FIG. 5 is a simplified block diagram of an automatic door interlock control used with the present invention.

A logic and door interlock control is depicted generally as 776 in FIG. 5. A logic block 118 represents a suitably programmed conventional process control computer with power supply 120. Block 722 represents the sensors or source of identification signals from entry chamber 46. Similarly, blocks 724, 126, 130 indicate sources of signals from the sensors in chambers 48, 50 and 52 respectively. The logic block 118 is responsive to signals from blocks 122, 724, 726 and 130. An internal program specifies conditions which must all be satisfied before the door interlock control will function to unlock the doors (or unlock and open the doors if the doors are of the automatic opening type). This function is provided by a door interlock control shown as block 132. Blocks 134, 136, 138, 140, 142 represent the actuating devices for the locks (or motors) of sliding doors 54, 58, 64, 70 and 76 respectively. When the remotely controlled door locks are operated, conveyor 16 is also advanced one station by a signal to the conveyor motor controller represented by block 124.

Lastly, security to surrounding personnel is provided by a manually operated panic button type override control indicated by a block 146. This may suitably be adapted to secure the locks on either side of a suspected security risk, while unlocking all other doors to allow evacuation of personnel. The override control 146 may also be operated automatically in case a sensor indicates a life-threatening situation. The aforementioned automated door interlock system depicted in FIG. 5 is arranged to remotely unlock the locks in a string of security chambers such as 24 to pass individuals successively through the chambers and to lock selected locks to detain selected individuals during monitoring. Each chamber also includes an outer access door having a lock permitting access only from outside the chamber. While one string of chambers has been described, the security system may be expanded to handle multiple queues by providing a matrix of two parallel line of chambers, such as lines 24, 26 with conveyors 16, 18 on either side. This basic arrangement can be duplicated to serve as many airline passengers as desired.

While the arrangement has been described for an airport security system, it is equally applicable to any public building handling large crowds, either with or without the accompanying conveyors for hand carried articles. Particularly in banking or money exchange operations, the conveyors may be omitted and each string of security chambers may terminate at a teller serving each queue of individuals.

While there has been described what is considered to be the preferred embodiment of the invention, other modifications will occur to those skilled in the art, and it is desired to secure in the appended claims all such modifications as fall with in the true spirit and scope of the invention.

What is claimed is:

1. A security system for monitoring and protecting personnel in an area including at least one queue of successively arriving individuals, comprising:

a plurality of at least three contiguous chambers, including an entry chamber, an exit chamber and at least one intermediate chamber, said chambers each having bullet-proof transparent walls and bullet-proof doors, said doors including:

an entry door to the entry chamber, an exit door from the exit chamber, a common door between each intermediate chamber and a said contiguous chamber, said doors having remotely controlled locks, and each chamber further including an outer access door to each said chamber, said outer access door having a lock permitting access only from outside the chamber, means for monitoring a selected individual in a selected chamber, and an automated door interlock system arranged and adapted to remotely unlock selected locks to pass individuals successively through said chambers, and to lock selected locks to detain selected individuals during monitoring.

2. The security system according to claim 1, wherein the automated door interlock system includes a security override control arranged to unlock all doors except those detaining an individual, when a monitoring means indicates a danger to personnel from the detained individual.

3. The security system to claim 1, wherein the automated door interlock system includes a security override control arranged to unlock all doors except those detaining an individual when the security override control is manually actuated.

4. The security system according to claim 1, including motor means adapted to open selected doors when they are unlocked and to close said selected doors when said monitoring means indicates presence of an individual in a selected chamber.

5. The security system according to claim 1, and further including a conveyor disposed alongside said chambers, and wherein said door interlock system is arranged to advance the conveyor by one chamber when said selected locks are unlocked to pass individuals from one chamber to the next.

6. The security system according to claim 1, wherein said monitoring means includes at least a personal identification entry device, a metal detector, and a physical presence sensor.

7. A security system for monitoring and protecting personnel in an area including at least one queue of successively arriving individuals, comprising:

a plurality of at least three contiguous chambers, including an entry chamber, an exit chamber and at least one intermediate chamber, wherein said chambers are arranged in a matrix of at least two parallel lines of chambers so as to receive at least two parallel queues of successively arriving individuals, said chambers each having bullet-proof transparent walls and bullet-proof doors, said doors including:

an entry door to the entry chamber, an exit door from the exit chamber, a common door between each intermediate chamber and a said contiguous chamber, said doors having remotely controlled locks, means for monitoring a selected individual in a selected chamber, and an automated door interlock system arranged and adapted to remotely unlock selected locks to pass individuals successively through said chambers, and to lock selected locks to detain selected individuals during monitoring.

8. The security system according to claim 7, wherein the automated door interlock system includes a security override control arranged to unlock all doors except those detaining an individual, when a monitoring means indicates a danger to personnel from the detained individual.

9. The security system according to claim 7, wherein the automated door interlock system includes a security override control arranged to unlock all doors except those detaining an individual when the security override control is manually actuated.

10. The security system according to claim 7, including motor means adapted to open selected doors when they are unlocked and to close said selected doors when said monitoring means indicates presence of an individual in a selected chamber.

11. The security system according to claim 7, and further including a conveyor disposed alongside said chambers, and wherein said door interlock system is arranged to advance the conveyor by one chamber when said selected locks are unlocked to pass individuals from one chamber to the next.

12. The security system according to claim 7, wherein said monitoring means includes at least a personal identification entry device, a metal detector, and a physical presence sensor.

13. A security system for monitoring and protecting personnel in an area including at least one queue of successively arriving individuals, comprising:

a plurality of at least three contiguous chambers, including an entry chamber, an exit chamber and at least one intermediate chamber, and wherein a security and surveillance chamber extends alongside said contiguous chambers, each said contiguous chamber having an outer access door opening into said security and surveillance chamber, said outer access doors having locks permitting access only from the security and surveillance chamber, said chambers each having bullet-proof transparent walls and bullet-proof doors, said doors including:

an entry door to the entry chamber, an exit door from the exit chamber, a common door between each intermediate chamber and a said contiguous chamber, said doors having remotely controlled locks, means for monitoring a selected individual in a selected chamber, and an automated door interlock system arranged and adapted to remotely unlock selected locks to pass individuals successively through said chambers, and to lock selected locks to detain selected individuals during monitoring.

14. The security system according to claim 13 and further including a conveyor extending through the security and surveillance chamber and visible from said contiguous chambers.

15. The security system according to claim 13, wherein the automated door interlock system includes a security override control arranged to unlock all doors except those detaining an individual, when a monitoring means indicates a danger to personnel from the detained individual.

16. The security system according to claim 13, wherein the automated door interlock system includes a security override control arranged to unlock all doors except those detaining an individual when the security override control is manually actuated.

17. The security system according to claim 13, including motor means adapted to open selected doors when they are unlocked and to close said selected doors when said monitoring means indicates presence of an individual in a selected chamber.

18. The security system according to claim 13, and further including a conveyor disposed alongside said chambers, and wherein said door interlock system is arranged to advance the conveyor by one chamber when said selected locks are unlocked to pass individuals from one chamber to the next.

19. The security system according to claim 13, wherein said monitoring means includes at least a personal identification entry device, a metal detector, and a physical presence sensor.

* * * * *

UNITED STATES PATENT AND TRADEMARK OFFICE

CERTIFICATE OF CORRECTION

PATENT NO. : 6,484,650 B1 
DATED : November 26, 2002
INVENTOR(S) : Stomski, Gerald D.

It is certified that error appears in the above-identified patent and that said Letters Patent is hereby corrected as shown below:

Column 2,
Line 65, cancel “74” and substitute -- 14 --.

Column 3,
Line 1, cancel “78” and substitute -- 18 --;
Line 2, cancel “76” and substitute -- 16 --;
Line 3, cancel “78” and substitute -- 18 --;
Line 22, cancel “78” and substitute -- 18 --.

Column 5,
Line 3, cancel “714” and substitute -- 114 --;
Line 8, cancel “776” and substitute -- 116 --;
Line 10, cancel “772” and substitute -- 122 --;
Line 12, cancel “724” and substitute -- 124 --;
Line 15, cancel “724, 726” and substitute -- 124, 126 --.

Signed and Sealed this

Twenty-second Day of July, 2003

JAMES E. ROGAN
*Director of the United States Patent and Trademark Office*